US009099064B2

(12) United States Patent
Sheffer et al.

(10) Patent No.: US 9,099,064 B2
(45) Date of Patent: Aug. 4, 2015

(54) METHOD FOR EXTRACTING REPRESENTATIVE SEGMENTS FROM MUSIC

(71) Applicant: Play My Tone Ltd., Tel Aviv (IL)

(72) Inventors: Ohad Sheffer, Tel Aviv (IL); Kobi Calev, Tel Aviv (IL); Omri Cohen Alloro, Tel Aviv (IL)

(73) Assignee: Play My Tone Ltd., Tel Aviv (IL)

( * ) Notice: Subject to any disclaimer, the term of this patent is extended or adjusted under 35 U.S.C. 154(b) by 0 days.

(21) Appl. No.: 14/362,129

(22) PCT Filed: Nov. 29, 2012

(86) PCT No.: PCT/IL2012/050489

§ 371 (c)(1),
(2) Date: Jun. 2, 2014

(87) PCT Pub. No.: WO2013/080210

PCT Pub. Date: Jun. 6, 2013

(65) Prior Publication Data

US 2014/0338515 A1 Nov. 20, 2014

Related U.S. Application Data

(60) Provisional application No. 61/565,513, filed on Dec. 1, 2011.

(51) Int. Cl.
*A63H 5/00* (2006.01)
*G04B 13/00* (2006.01)
(Continued)

(52) U.S. Cl.
CPC ..... *G10H 1/0008* (2013.01); *G10H 1/36* (2013.01); *G10H 2210/061* (2013.01); *G10H 2210/071* (2013.01); *G10H 2250/135* (2013.01)

(58) Field of Classification Search
USPC ..... 84/609, 611; 700/94
See application file for complete search history.

(56) References Cited

U.S. PATENT DOCUMENTS 7,371,958 B2 * 5/2008 Kim et al. ..... 84/609
7,522,967 B2 * 4/2009 Zhang et al. ..... 700/94

(Continued)

OTHER PUBLICATIONS

International Search Report dated Mar. 24, 2013 for PCT/IL2012/050489.

(Continued)

*Primary Examiner* — Jeffrey Donels
(74) *Attorney, Agent, or Firm* — Lowenstein Sandler LLP

(57) ABSTRACT

A method for extracting the most representative segments of a musical composition, represented by an audio signal, according to which the audio signal is preprocessed by a set of preprocessors, each if which is adapted to identify a rhythmic pattern. The output of the preprocessors that provided the most periodic or rhythmical patterns in the musical composition selected and the musical composition is divided into bars with rhythmic patterns, while iteratively checking and scoring their quality and detecting a section that is a sequence of bars with score above a predetermined threshold. Checking and scoring is iteratively repeated until all sections are detected. Then similarity matrices between all bars that belong to the musical composition are constructed, based on MFCCs of the processed sound, chromograms and the rhythmic patterns. Then equivalent classes of similar sections are extracted along the musical composition. Substantial transitions between sections represented as blocks in the similarity matrices are collected and a representative segment is selected from each class with the highest number of sections.

20 Claims, 9 Drawing Sheets

(51) Int. Cl.

| | |
|---|---|
| ***G10H 7/00*** | (2006.01) |
| ***G10H 1/00*** | (2006.01) |
| ***G10H 1/36*** | (2006.01) |

(56) References Cited

U.S. PATENT DOCUMENTS

| | | | | |
|---|---|---|---|---|
| 7,599,554 | B2 * | 10/2009 | Agnihotri et al. | 382/173 |
| 7,659,471 | B2 * | 2/2010 | Eronen | 84/600 |
| 2005/0004690 | A1 * | 1/2005 | Zhang et al. | 700/94 |
| 2006/0080100 | A1 * | 4/2006 | Pinxteren et al. | 704/249 |
| 2006/0210157 | A1 * | 9/2006 | Agnihotri et al. | 382/173 |
| 2007/0113724 | A1 * | 5/2007 | Kim et al. | 84/609 |
| 2008/0236371 | A1 * | 10/2008 | Eronen | 84/622 |
| 2009/0019996 | A1 | 1/2009 | Fujishima et al. | |
| 2009/0277322 | A1 | 11/2009 | Cai et al. | |
| 2013/0046399 | A1 * | 2/2013 | Lu et al. | 700/94 |
| 2013/0231761 | A1 * | 9/2013 | Eronen et al. | 700/94 |
| 2014/0172429 | A1 * | 6/2014 | Butcher et al. | 704/270 |

OTHER PUBLICATIONS

Written Opinion of the International Searching Authority dated Mar. 24, 2013 for PCT/IL2012/050489.

Jakub Glaczynski, Ewa Lukasik, "Automatic Music Summarization. A "Thumbnail" Approach", Poznan University of Technology, Faculty of Computing Science, Institute of Computing Science. Archives of Acoustics, Publisher Versita, Warsaw. Issue vol. 36, No. 2, pp. 297-309. May 2011.

* cited by examiner

METHOD FOR EXTRACTING REPRESENTATIVE SEGMENTS FROM MUSIC

CROSS-REFERENCE TO RELATED APPLICATIONS

This application is a US National Stage application of International Application No. PCT/IL2012/050489, filed Nov. 29, 2012, which claims the benefit of U.S. patent application Ser. No. 61/565,513 filed on Dec. 1, 2011, each of which is hereby incorporated by reference in its respective entirety.

FIELD OF THE INVENTION

The invention relates to the field of digital sound processing. More particularly, the invention relates to a method and system for analyzing a musical composition and extracting the most representative segments of that composition.

BACKGROUND OF THE INVENTION

Music compositions such as songs, popular music and music which involve a mixture of vocals and musical instruments are available online and offline in the form of a file that may be played by using almost any audio and computerized terminal devices. Such devices include audio players, computers, laptops, mobile phone and mobile music players and are widespread among many users. In fact, almost each person that carries an audio player and a personal terminal device that can play music is a consumer of music. However, since users are exposed to huge amount of new musical content, they hardly have the time or patience to listen to a whole composition in order to decide whether or not they like a new composition. Therefore, users prefer to get a short summary (a "thumbnail") of a new composition, before deciding whether or not to listen or purchase the whole composition. This summary should include the most representative, and most surprising segments, such as the most dominant and associative segments of the composition a chorus, or hook, which are strongly associated with a particular composition.

It is an object of the present invention to provide a method and system for generating a summary of musical composition in the form of the most representative segments of that musical composition.

It is another object of the present invention to provide a method and system for finding a segment with clear start and end point music-wise, so that the chosen segment stands as a complete and independent unit.

It is a further object of the present invention to provide a method and system for helping a user to associatively decide whether or not to listen to a whole new musical composition, according to the summary.

Other objects and advantages of the invention will become apparent as the description proceeds.

SUMMARY OF THE INVENTION

The present invention is directed to a method for extracting the most representative segments of a musical composition, represented by an audio signal, that comprises the steps of:

a) preprocessing the audio signal by a set of preprocessors (such as low-pass filters, division the signal's power into energy sections or rhythmical waveform preprocessors), each if which is adapted to identify a rhythmic pattern;

b) selecting the output of the preprocessors that provided the most periodic or rhythmical patterns in the musical composition;

c) dividing the musical composition into bars having rhythmic patterns, while iteratively checking and scoring their quality and detecting a section being a sequence of bars with score above a predetermined threshold;

d) iteratively repeating the preceding step until all sections are detected;

e) constructing similarity matrices between all bars that belong to the musical composition, based on MFCCs of the processed sound, chromograms and the rhythmic patterns;

f) extracting equivalent classes of similar sections along the musical composition;

g) collecting substantial transitions between sections represented as blocks in the similarity matrices; and h) selecting a representative segment from each class having the highest number of sections.

The method may further comprise one or more of the following steps:

a) dividing the audio signal into portions, based on energy levels;

b) adjusting the accurate boundaries of each section using the time points of transitions between energy levels and rhythmic patterns;

c) defining a representative bar for each section of the musical composition for approximating the local rhythmic pattern finding local periodicity in the processed sound waveform and taking the numeric average over N-periods of T, using autocorrelation;

d) defining a correlation scale, which compares a given pair of bars;

e) refining the representative parameters by removing outliers, using the correlation scale;

f) continuously comparing the average bar along the analyzed signal, until the correlation level is degraded;

g) marking the detected part as a rhythmical local constant, which represents a typical rhythmical pattern;

h) iteratively repeating the preceding steps, until the entire signal is extracted;

i) separating between stable and unstable frequency components across time frames and between tuned and untuned frequencies, using spectral frequency-estimation;

j) generating a "Thumbnail" that contains examples of both the most representative and most surprising parts of the musical composition.

Equivalent classes may repeat themselves in different time points along the audio file and include:

a chorus a verse a hook

A representative bar may be defined for a given local section by:

a) constructing an average-bar is by finding local periodicity within a section;

b) taking the numeric average over N-periods of T. The average bar approximates the local rhythmic pattern;

refining representative parameters of the bar by removing outlier bars with low correlation are, using the correlation scale; and c) averaging again while excluding the outlier bars.

The method may further comprise the step of continuously comparing the refined representative bar to an instantaneous bar of essentially similar period along the analyzed signal, while in each time, the next instantaneous bar is selected by hopping in time about the period of a bar, until the correlation level is degraded. The hopping time interval may be dynamic.

Harmonic patches and non-harmonic sounds may be filtered by separating frequencies that are located at equal-tempered spots, as well as frequencies that fall within the quartic tone offset.

DETAILED DESCRIPTION OF THE EMBODIMENTS OF THE INVENTION

According to the present invention, a musical file is analyzed in order to generate a "Thumbnail" that contains examples of both the most representative and most surprising parts of a musical composition. At the first step, a similarity matrix of the given music file is generated by analyzing the file and tagging similar parts, self-similar parts (segments which are similar to themselves), tempo-changes, and surprising elements into equivalent classes. These equivalent classes repeat themselves in different time points along the audio file, for example a chorus or a verse that appears in several time points along the song. At the next step, several relevant parts to be present the user are selected as building blocks for generating a musical thumbnail, which helps the user associating the thumbnail with his preferences and deciding whether or not to listen to the whole file.

Energy Division

According to the method proposed by the present invention, the song is broken into parts that have the same energy level and the point of abrupt changes between adjacent levels is detected. For a given signal, the energy is averaged over short time segmentation (e.g., 2 Sec).

It is desired to find the exact points of change. For each change point, the process goes back to the signal and trims a 4 Sec area from both sides of the roughly estimated change. At the next step, a moving average M(t) is applied with the same segmentation as started. At the next step, the function $$P(t) = \frac{M(t)}{M(t-l)}$$

Where l is the number of samples of the segmentation used. The term Max(P(t)) provides the desired correction. Readjusting these change moments allows locating the Downbeat (the first beat of a measure, which generally has the highest energy density of the bass frequencies of the composition).

Energy distribution over any scale may be used to define that musical scale (e.g., western or Indian musical track), as well as the genre.

Figure 5:
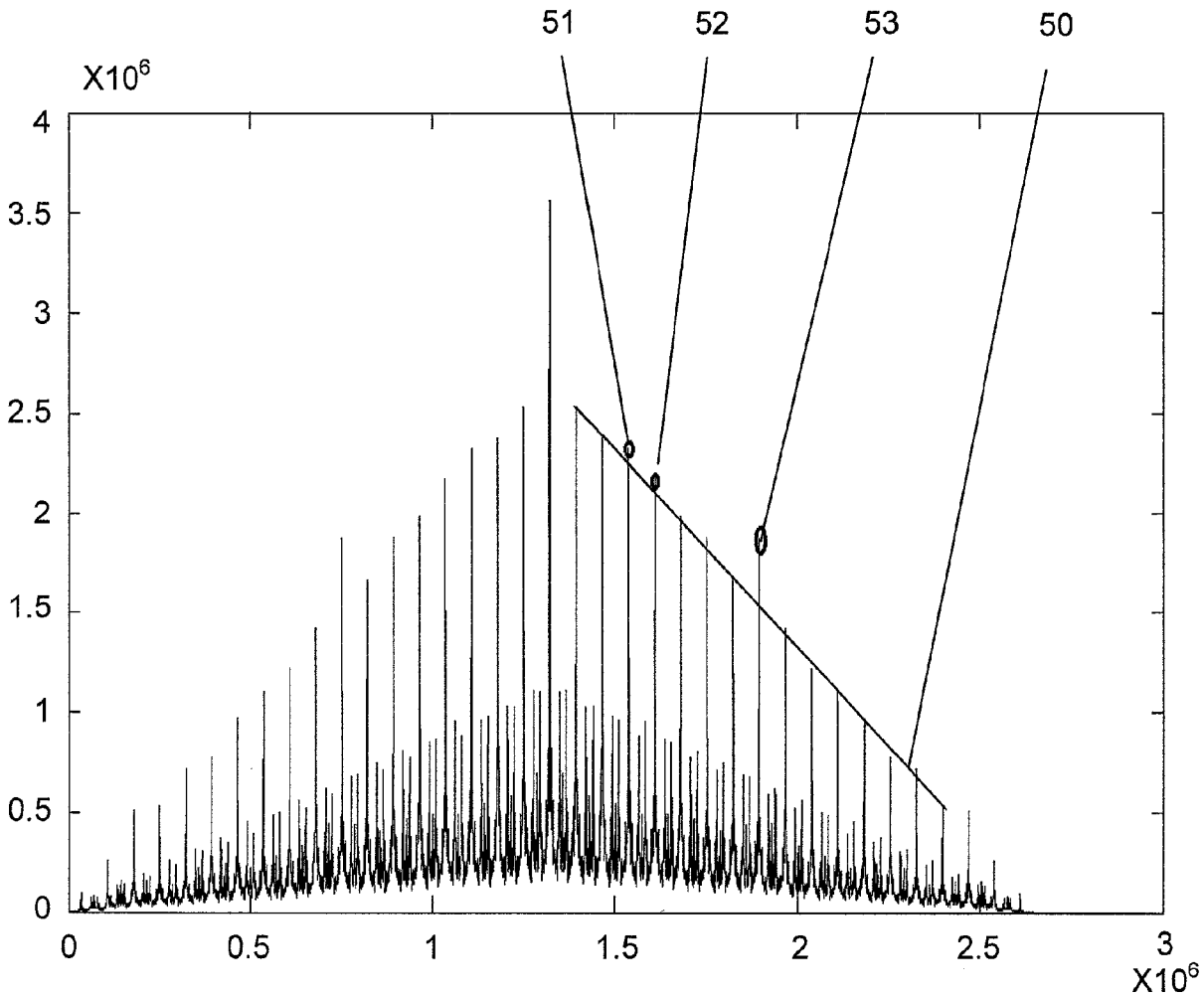
FIG. 5 illustrates an example of autocorrelation of a song with dominant multiplicity of 8 bars.

FIG. 5 illustrates an example of autocorrelation of the song "cry me a river" of the performer Justin Timberlake with detected dominant multiplicity of 8 bars. The energy levels are equally spaced peaks, which show how much the signal that is sampled in 44.1 Khz rate is similar to itself in different shifts. The x axis represents time*the sampling frequency and the y axis represents energy levels, while the highest peak (not normalized) is obtained with no shift. The peak levels drop linearly along line 50, as the similarity is degraded from bar to bar. As seen, there are 3 peaks 51, 52 and 53 that exceed the energy levels bounded by line 50. These peaks correspond to higher periodicity of the rhythmic pattern, while the $8^{th}$ peak provides the highest energy. Thus, the rhythmic pattern is repeated after 8 bars.

Figure 6B:
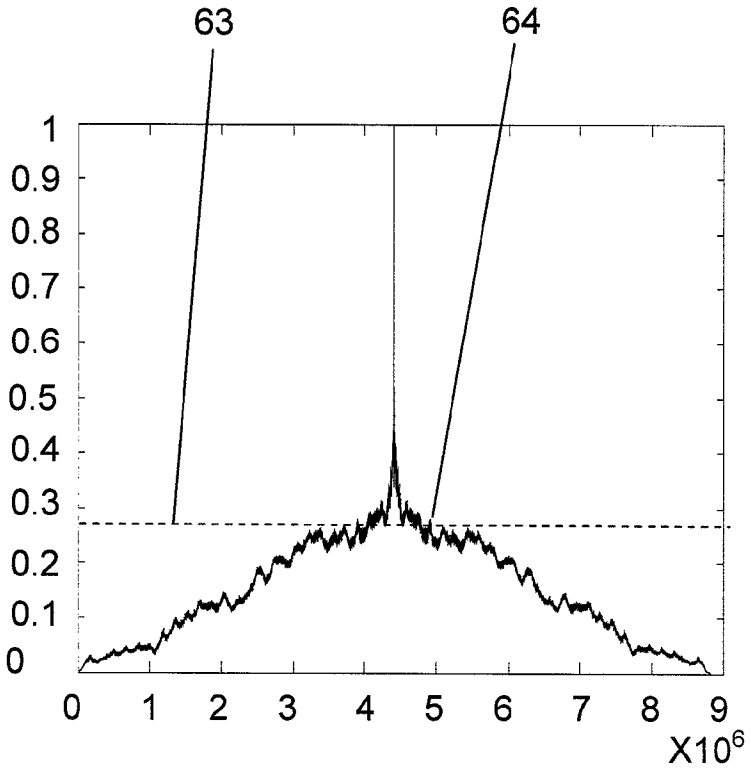
FIGS. 6A and 6B illustrate examples of autocorrelation of autocorrelations of low-passed energy of two different songs.
Figure 6A:
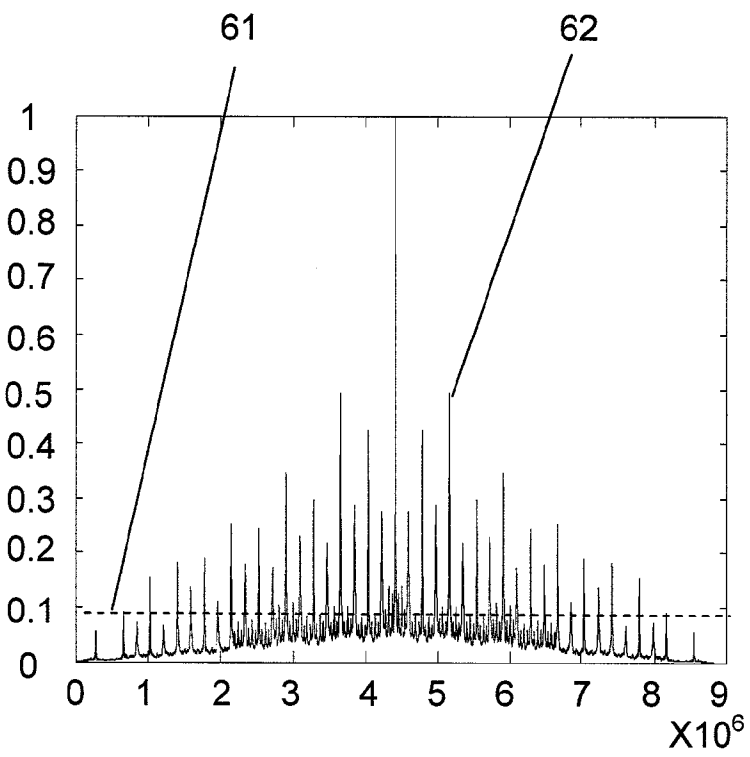

FIGS. 6A and 6B illustrate examples of autocorrelation of autocorrelations of low-passed energy from seconds 40 to 50, of two different songs. FIG. 6A shows the autocorrelations of the song "A day in life" with high rhythmical score. As seen from FIG. 6A, most of the peaks exceed the median energy level 61 (taken with respect to the highest peak 62. Thus, the rhythmic pattern of this song has a high score.

FIG. 6B shows the autocorrelations of the album "Rio" of Duran Duran, with low (Drone-like) rhythmical score. As seen from FIG. 6B, most of the peaks do not exceed the median energy level 63 (taken with respect to the highest peak 64. Thus, the rhythmic pattern of this song has a low score.

Bar Units Division, BPM Extraction and Rhythmical Patterns Segmentation:

Three types of rhythmical divisions are extracted according to the process proposed by the present invention. Musical bars units are the short time rhythmic repetitions along the track. This process takes into consideration that bar units may change in their length, during the whole song. Musical bars units might change abruptly, or while accelerating or slowing down. Yet, the basic assumption of local periodicity of the rhythmical waveform (any waveform preprocessing which produces waveform with local periodicity) is valid for most cases. The local length of the bar unit induces the local shape of the repetitive rhythmic waveform. This feature is the local rhythmical pattern of the bar. Analyzing the rhythmical bar pattern reveals the local Beats Per Minute (BPM). Moreover, marking the moment where rhythmical bar patterns substantially change allow obtaining the rhythmical patterns segmentation, i.e., segmentation into sections of constant rhythmical patterns of the bar units.

The process seeks a preprocessor which isolates the 'rhythmic component' of the song, using the following tools:

(1) a set of rhythmical waveform preprocessors.

(2) a rhythmical scale function that takes any power waveform and gives a 'rhythmicity' score that represents the local periodicity level of the waveform (in a range of about 0.6-4 sec).

The processing steps are:

1. At the first step, a short section is selected from the beginning of the song.
2. At the next step, the set of preprocessors is applied on the selected section.
3. At the next step, the scale function is used to choose the best rhythmical waveform by scoring. If there isn't any positive score the section is classified as 'not rhythmical' and the process restarts.
4. At the next step, autocorrelation is performed on the rhythmical waveform and the maximum over the range of 0.6-4 sec is selected. The distance between the inducted maximum and the zero offset will be the static bar length of the section.
5. At the next step, a linear estimator is applied on the static bar length periods point in the autocorrelation signal and multiplied points which are above the line are taken. Any multiplicity number represents a bars multiplicity of the section.

6. At the next step, the static bar length is used to build a representative bar of the section which is defined as the average sum over the n-th' static bars contained in the section.

7. At the next step, the representative bar is refined by comparing it with each of the n-th' static bars using the bar_compare function, defined as $$BarCompare(X, Y) = \max\left(cyclicCorrelation\left(\frac{X}{|X|}, \frac{Y}{|Y|}, \delta\right)\right),$$

and the average is taken over the five best score bars as the new refined representative bar. At this stage, in order to detect the bar units performances, a bar_compare function is defined. This function traces the correlation of the given representative bar along the given rhythmical signal, using the following formula:

$$\text{Bar_segmentation}(s,b)=\text{Cross-correlation}(s,b)/\text{convolution}(s^2,u)$$

Where b is the normalized representative bar, s is the compared signal and l is the length of the normalized representative bar b.

The division by convolution ($s^{32}$, u) will normalized each offset of the cross-correlation. Therefore, energy difference has no meaning and the only property that matter is the inner energy distribution of the compared signal s on each offset.

9. At the next step, the correlation signal c is derived and a looseness parameter δ=0.2 Sec is defined. A local maximum is traced inductively by:

i) finding max over c(1: δ*fs) and saving the value—v(1), and index—i(1).

ii) Since at the kth step an array k*2 of values and indexes is obtained, max is found over c(δ*fs−i(k):δ*fs+i(k)) while saving the value in v(k+1) and index in i(k+1).

iii) terminating the process upon either extracting the whole track or getting two consecutive bad scores in the value array.

At this stage, a section of the song, divided into bar units, is obtained. These bar units are locally constant in their length (up to looseness δ). Each bar has its value that represents the distance from the rhythmical representative bar.

10. At the next step, the 'bad' scores bars are saved in the section. The corresponding time points indicate bridges or transitions in the track.

11. At the next step, the process is repeated starting from the end of the last section.

The above process ends with segmentation into rhythmical patterns sections, each of which contains bar division and a representative bar which represent the rhythmical pattern and shows the BPM. In addition the multiplicity of a bar is extracted (if exists) and the bars with 'bad score' are saved.

Preprocessors Set and Rhythmic Scale Function

As mentioned before, the former process relies on extracting the rhythmical component from the audio track. Therefore we search from the set of preprocessors the suitable one, e.g—preprocessed power waveform that is the 'most periodic'. Let as, then, define our Rhythmic Scale Function:

Denote C—the normalized autocorrelation of a given power signal—s.

Denote also m=max(C(δ, end)), i—the index of m in C, where δ=0.2 sec*fs. then $$\text{score}(s)=1-\text{mean}(C(\delta,i))/m.$$

Note that 0<m<1 express the measure of the periodicity (when m=1 gives a perfect period) while our score measure the level of the i period compare to the average of the level of any other periods. This way drone sound (unity distributed waveform) cannot be considered a periodic (even when m tend to 1).

Preprocessor Set:

Attacks Detector Preprocessor:

The signal's power is divided first into energy sections (see Energy division section later). For each section, a "creamy" layer of the signal is selected. This layer includes samples which exceed a predetermined height (according to some percentile) and their between, for gaps that are small enough.

Separating Between Melodic, Percussive and Vocal Events

There are some typical attributes regarding frequency distribution in western-musical tracks. Firstly, most of the melodic instrument energy is distributed around Equal Tempered frequencies (in an Equal Tempered Scale, which is a musical scale with 12 equal divisions of the octave), such as a logarithmic 12 tone scale based around a pitch of 440 Hz (or any other arbitrary frequency). Secondly, most of the frequency components which are far away from the tuned scale are either non-harmonic resonance frequencies (including some vocal formants, which are spectral peaks of the sound spectrum the voice) or part of percussive events. Thirdly, percussive events are broad-band with different time distribution.

By using spectral frequency-estimation (estimation of frequency components using the complex time derivative of the Short-Term Fourier Transform—STFT, which is a Fourier-related transform used to determine the sinusoidal frequency and phase content of local sections of a signal), it is possible to separate between stable and unstable frequency components across time frames and between tuned and un-tuned frequencies, according to a 12-tone equal temperament (a scale which divides the octave into 12 parts, all of which are equal on a logarithmic scale).

The tuned data (frequency tuning is made around a small fraction neighboring the border line between adjacent parts among these 12 parts) is used for extracting musical notation. Finding the root note (the fundamental note on top of which the intervals of a chord are built) around which the energy is distributed, helps finding the recording's tuning or altering of the playing speed. The separated un-tuned data is used for beat detection, and for correlating timbre or vocal patterns.

Harmonic patches and non-harmonic sounds are filtered by separating frequencies that are located at equal-tempered spots, as well as frequencies that fall within the quartic tone offset. The filters are very narrowband selective logical filters (few Hz), which are determined using Spectral-Frequency-Estimation and are capable of separating between harmonic and noisy (non-harmonic) signals.

Downbeat Location:

The first candidate for the Downbeat location will be the maximum energy point in the low-passed Representative-Bar. When dealing with 4/4 pop music, usually either the 1st or the 3rd beat are found. Another candidate will be the nearest "change moment" taken from previous measures (such as energy, notation, etc.). The point is projected through the whole section with shifts of the length of the bar.

Quality Scales

Correlation Scale

In order to determine whether a waveform is periodic enough (the rhythmic component), the following scale is performed:

If C be the normalized autocorrelation of the signal's power, i is it's index and m=max(C(δ, end), the score θ is given by:

$$\theta = 1 - \frac{\text{mean}(c[\delta, i])}{m}\Big)\Big) \quad \text{[Eq. 2]}$$

Where δ is selected to be samples of 0.1 Sec and m is a positive value such that m>δ.

Similarity Matrices

The similarity matrices (maps) are generated by both selecting temporal grids and different metrics, which measure musical similarity in different aspects, according to the division to bars, to tempo change detection and to various measures and internal bar tempo-maps that are defined. According to an embodiment of the invention, Time vs. Time similarity matrices are constructed based on these different metrics. The similarity matrix offers pairwise similarity between any two short intervals of fixed length in an analyzed song. Dynamic bar-length (BPM) changes and musical-meter changes are followed and the measured data reflects musical content when the time-division corresponds to the underlying musical temporal intervals.

The metrics used are:

1. Mel-Frequency-Cepstrum-Coefficients (MFCC)-based coefficients—to correspond to the Timbral content of a bar. Specifically, a Mel-scale filter-bank and the Discrete-Cosine-Transform (DCT) of the energy-sum logarithm are taken, together with two-time-derivatives of the above. The result is a vector of coefficients for each bar. The Cosine-Similarity between these vectors, as well as the inverse-cosine of their normalized dot-product, is calculated.

2. Internal Auto-Correlation measure—which corresponds to the rhythmic signature of the bar. The auto-correlation of each bar's energy levels is calculated, possibly after a preprocessor that has been selected earlier, during the bar division section. The resulting autocorrelation graph corresponds to the bar's internal rhythmic structure, with phase information removed. These graphs are compared with two different metrics:

2a: Approximating the curve via a low number of coefficients: for example—taking a DCT of the auto-correlation, and keeping the low 80 coefficients. Here also, the normalized coefficients of a bar's energy auto-correlation is taken, and its time derivative (the original autocorrelation pattern should be when sampling at standard 44.1 Khz—between 15,000 and 70,000 samples. These vectors are mapped from a 70,000 dimensional space to about a 100 dimensional space). Then the Euclidian distance is taken in the new dimension-reduced space. Approximating these curves via Linear Predictive Coding (LPC), using Reflection-Coefficients as the vectors for comparison also yields good result.

2b: Peak-Location in the autocorrelation—the autocorrelation passes a low-pass filter, in order construct a vector of only the dominant peak locations, giving minimal peak height, and a maximal peak distance, so-that 24 evenly-spaced peaks could fit into the bar time-frame. Then, either the peak-location, in percentage of the bar, or a binary-vector of 24 locations is saved (using Hamming-distance between the binary vectors.

3. Tonal-Tuned metric: corresponds to the tonal melodic-harmonic content of the sound track. The Short-Time-Discrete-Fourier-Transform, and then Frequency-Estimation are used, in order to find stable frequencies around a narrow frequency band, when the most stable energy distribution is found, like the one described with respect to the Tuning-Preprocessor.

Figure 7:
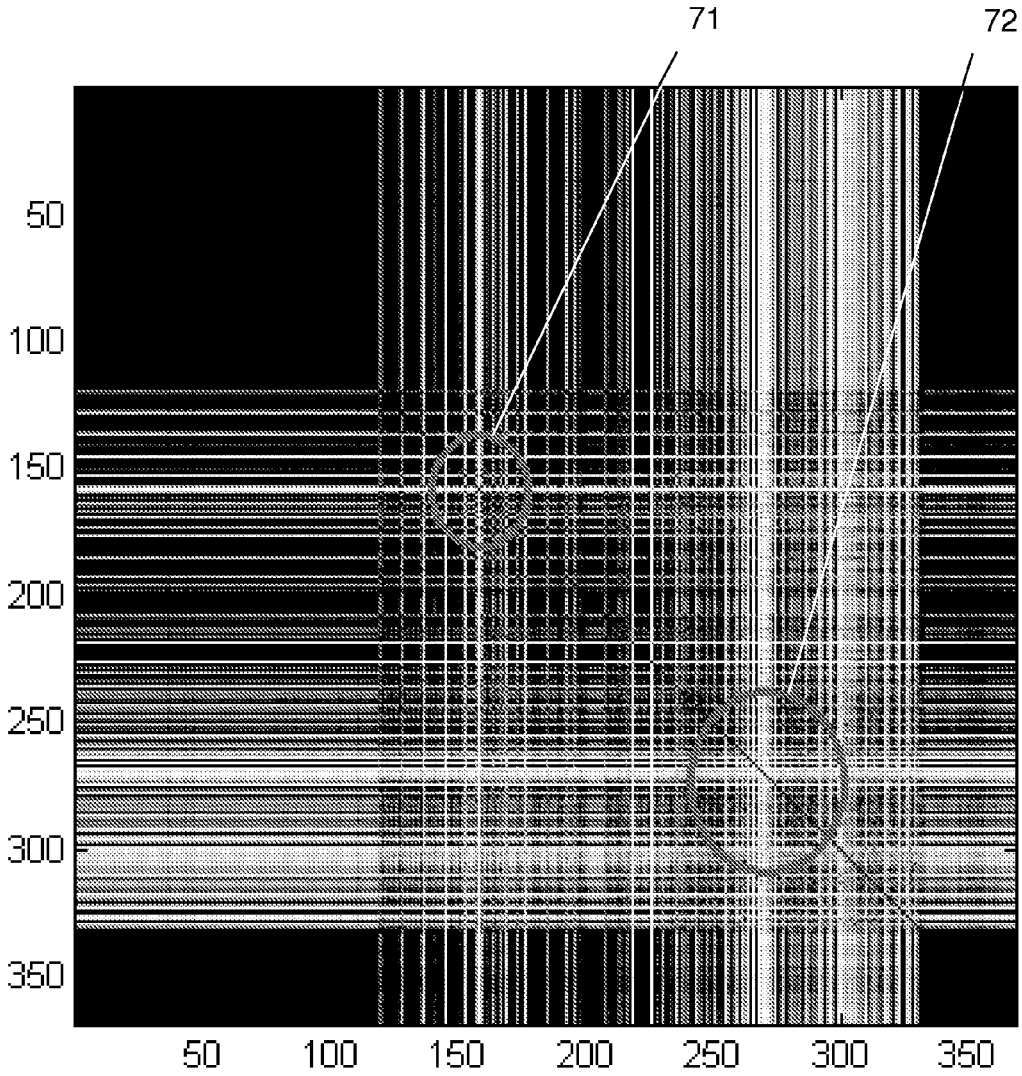
FIG. 7 illustrates regions of non-typical sections in a similarity matrix.

After the Similarity Matrices are built diagonals are marked, in order to divide the tracks into equivalent classes, while seeking only sub-diagonals that are inclined in 45°, in order to find parts of equal duration (e.g., a chorus of a song, a recurring verse, or recurring fill). The matrices divided into blocks using local textures and division lines. At the next step, distinctive non-typical sections in each matrix are found—as the matrices are similarity matrices—dis-similar sections are simply sections with higher than median value, which are easy to locate. In a similarity matrix, non-typical sections are regions that form a white line along the array of pixels, except for a black square which represents self-similarity near the mail diagonal. These non-typical sections are illustrated in FIG. 7 by the crosses in balloons 71 and 72.

Then, two representatives are selected to represent the two largest equivalent classes, and a third section containing a distinctive section (other different configuration parameters may also be presented, based on the results of this analysis). The exact boundaries of the selected parts are then adjusted via the bars multiplicity that has been calculated before.

Each element (pixel) in a similarity matrix represents the comparison results between a pair of bars identified at time i and time j. Pixels with higher intensity or mutual color provide indication about bars which have high similarity. This way, it is possible to identify bars with unique similarity patterns. Usually, these bars will belong to diagonals that are parallel to the main diagonal of the matrix (inclined in 45°), so as to avoid time distortions. The exact boundaries of the selected parts—are then adjusted via the bars multiplicity calculated before.

Energy level distributions may be also used to help deciding where each identified diagonal starts and ends.

Other smaller matrices are built for this purpose:

1. Matrices comparing Representative-Bars only, as described before. These matrices are typically sized 8×8 for a 5 minute song (where as the full similarity matrices are typically around 300×300)
2. Matrices in the Multiplicity-Scale, which is integrating the metrics for groups of bars, in the size of the multiplicity as described before.

Figure 1:
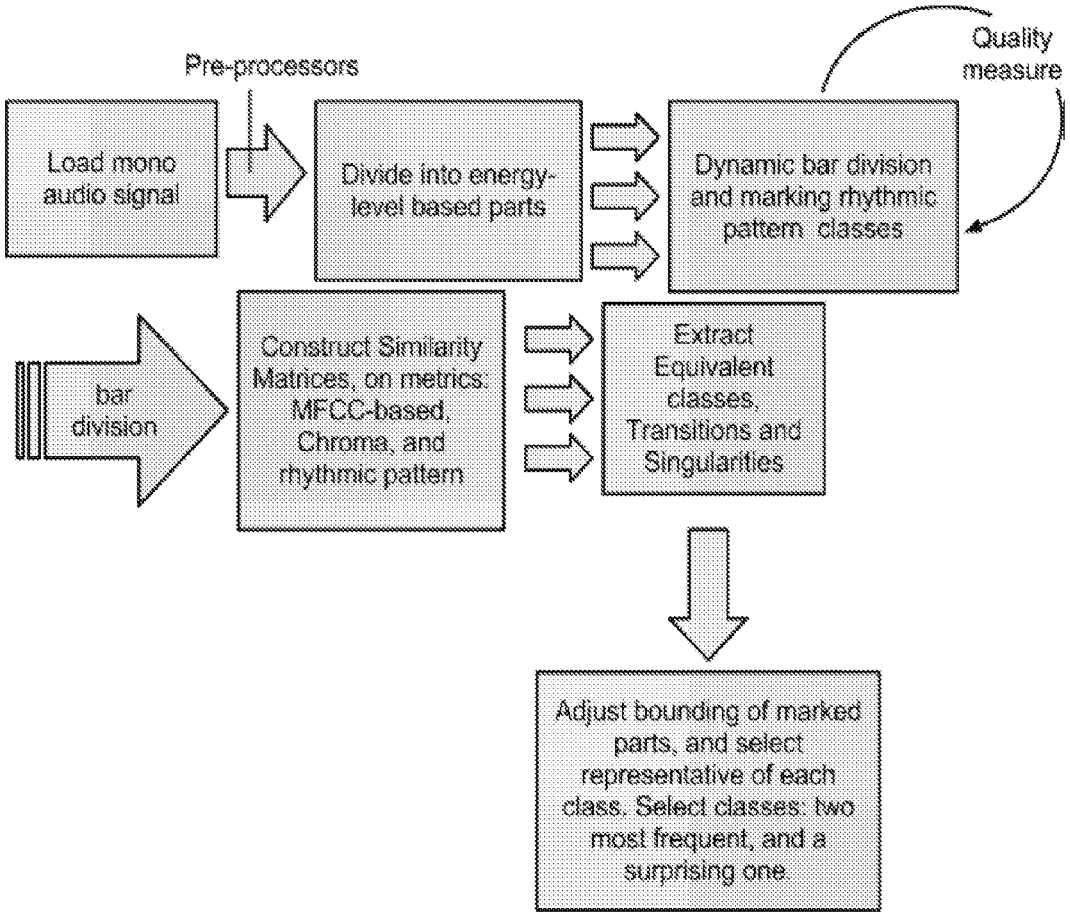
FIG. 1 illustrates the process for extracting the most popular and representative segments of a song, according to the present invention.

FIG. 1 illustrates the process for extracting the most popular and representative segments of a song (musical composition), according to the present invention. At the first step, the audio signal is loaded for analysis. At the next step, the audio signal is preprocessed by a set of preprocessors in the form of low-pass filters that are used to concentrate the rhythmic component in the song. At the next step, the audio signal is divided into portions, based on energy levels. At the next step, the song is divided to dynamic bars and rhythmic pattern classes are generated, while checking their quality. At the next step, similarity matrices are constructed, based on MFCCs of the processed sound and the rhythmic patterns. At the next step, classes, substantial transitions between bars and singularities are extracted. At the next step, a representative segment is selected from each class.

EXAMPLE 1

The Song "You Got Me" Performed by "the Roots—Featuring Erykah Badu (Vocals)"

Figure 2A:
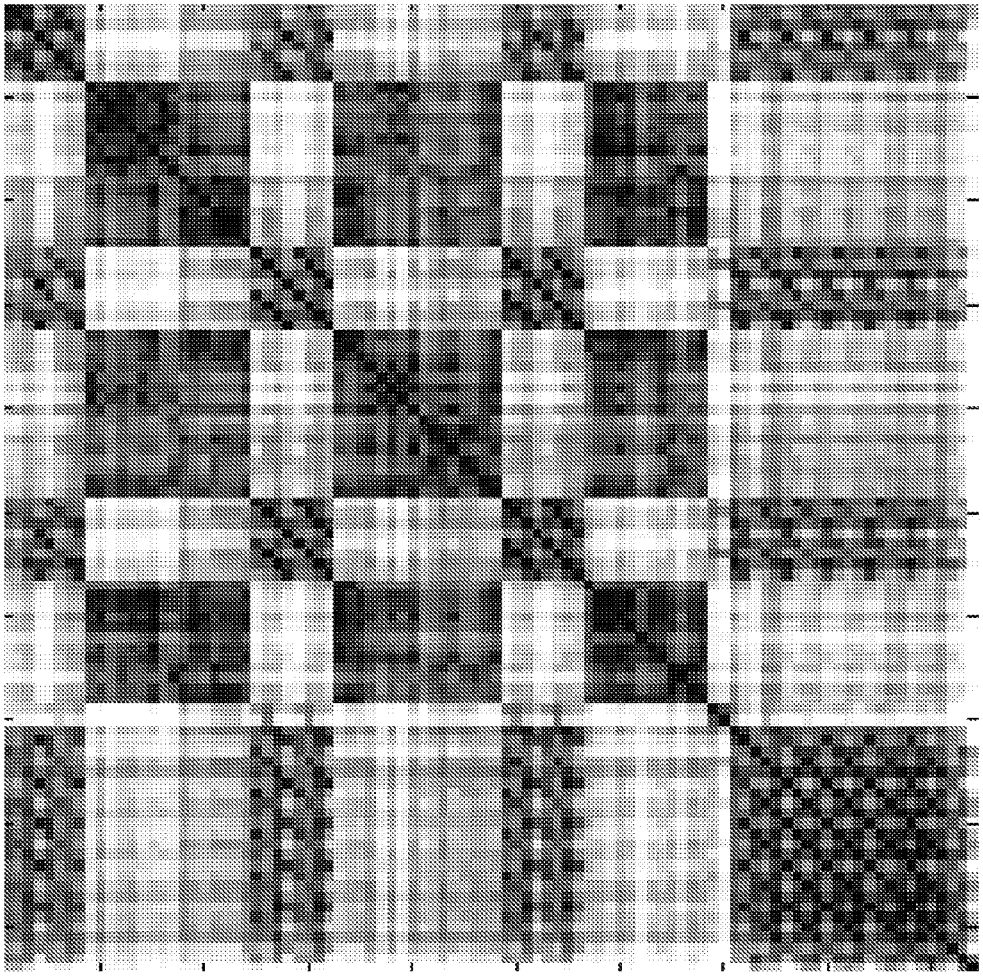
FIGS. 2A and 3A illustrate the MFCCs matrix of two different pop songs.

FIG. 2A illustrates the MFCCs matrix of this song. The dark diagonals represent repetitions of the chorus. In this matrix comprises pixels in a grayscale, where darker pixels indicate a higher similarity level (it can be seen that the main diagonal is black). The grayscale levels pass a histogram, which converts the pixel values to a binary black and white scale, in which white diagonals can be identified. Only diagonals that are displaced from the main diagonal are considered—the minimal distance should be at least the diagonal length.

Figure 2B:
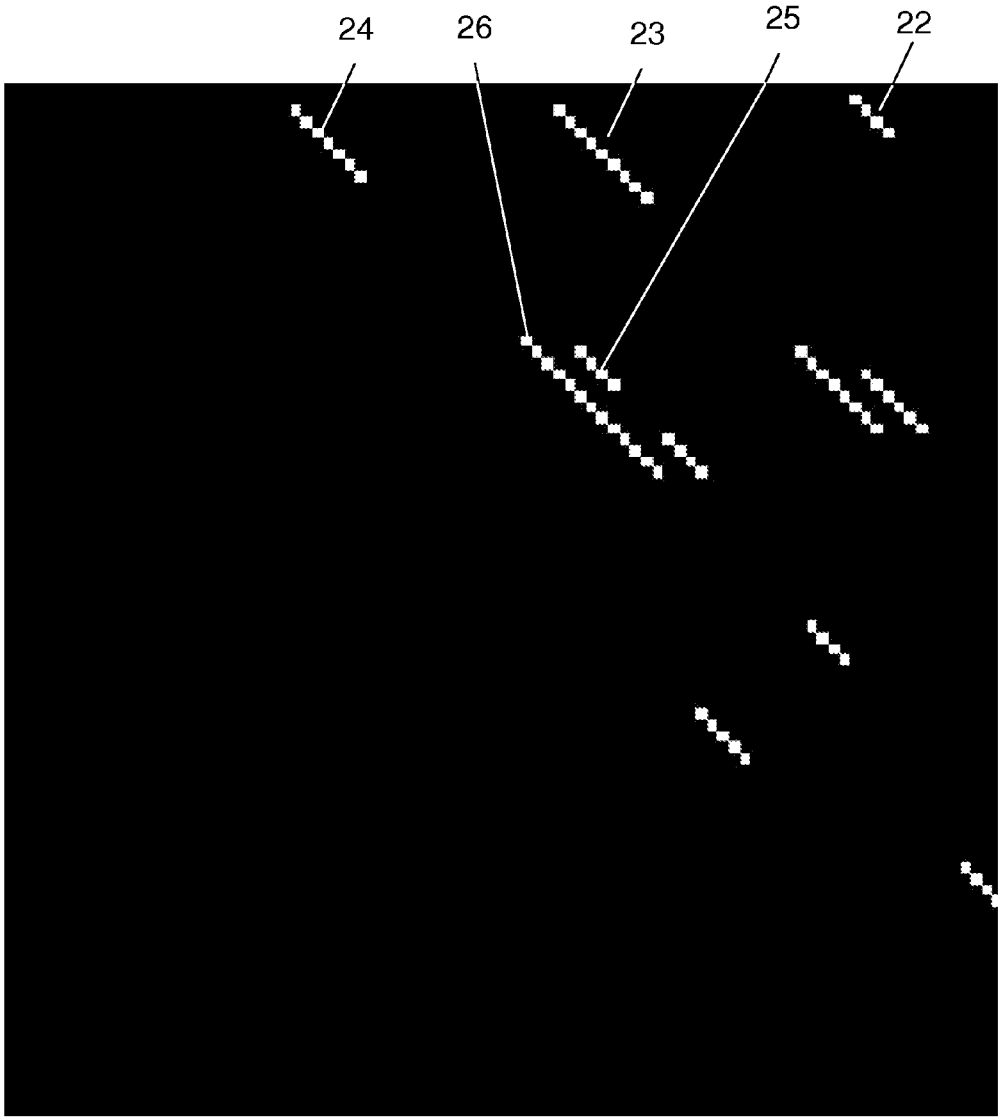
FIGS. 2B and 3B illustrate the extracted diagonals of the matrices shown in FIGS. 2A and 3A, respectively.

The extracted diagonals are illustrated in FIG. 2B. In this case, it can be seen that is possible to associate between diagonals that belong to a mutual equivalent class (a cluster). For example, diagonals 22, 23 and 24 define an equivalent class, since they contain pixels that overlap in x dimension. Similarly, diagonals 23, 25 and 26 define another equivalent class, since they contain pixels that overlap in y dimension.

EXAMPLE 2

The "C-Part" from the Album Rio by Duran-Duran

Figure 3A:
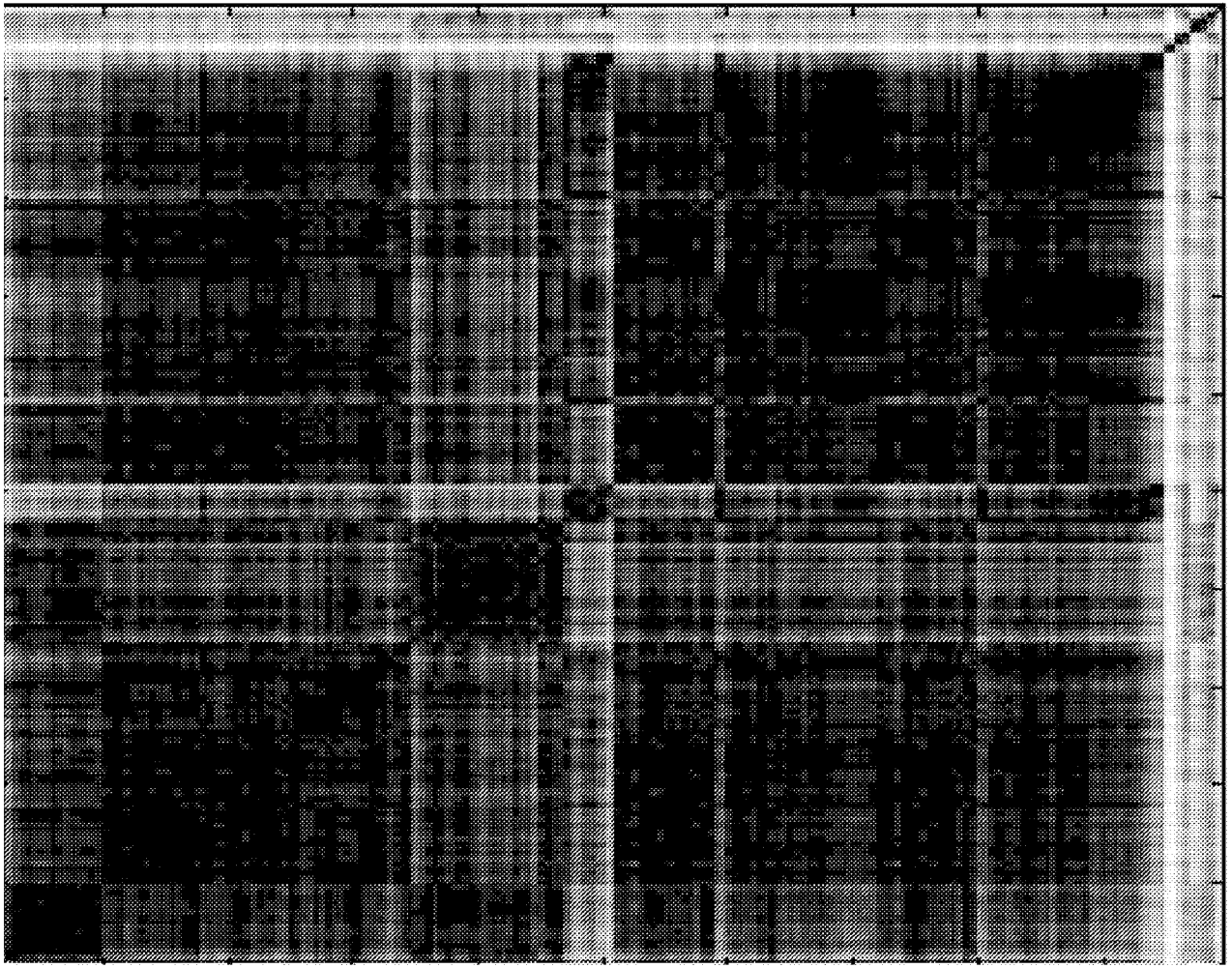
Figure 3B:
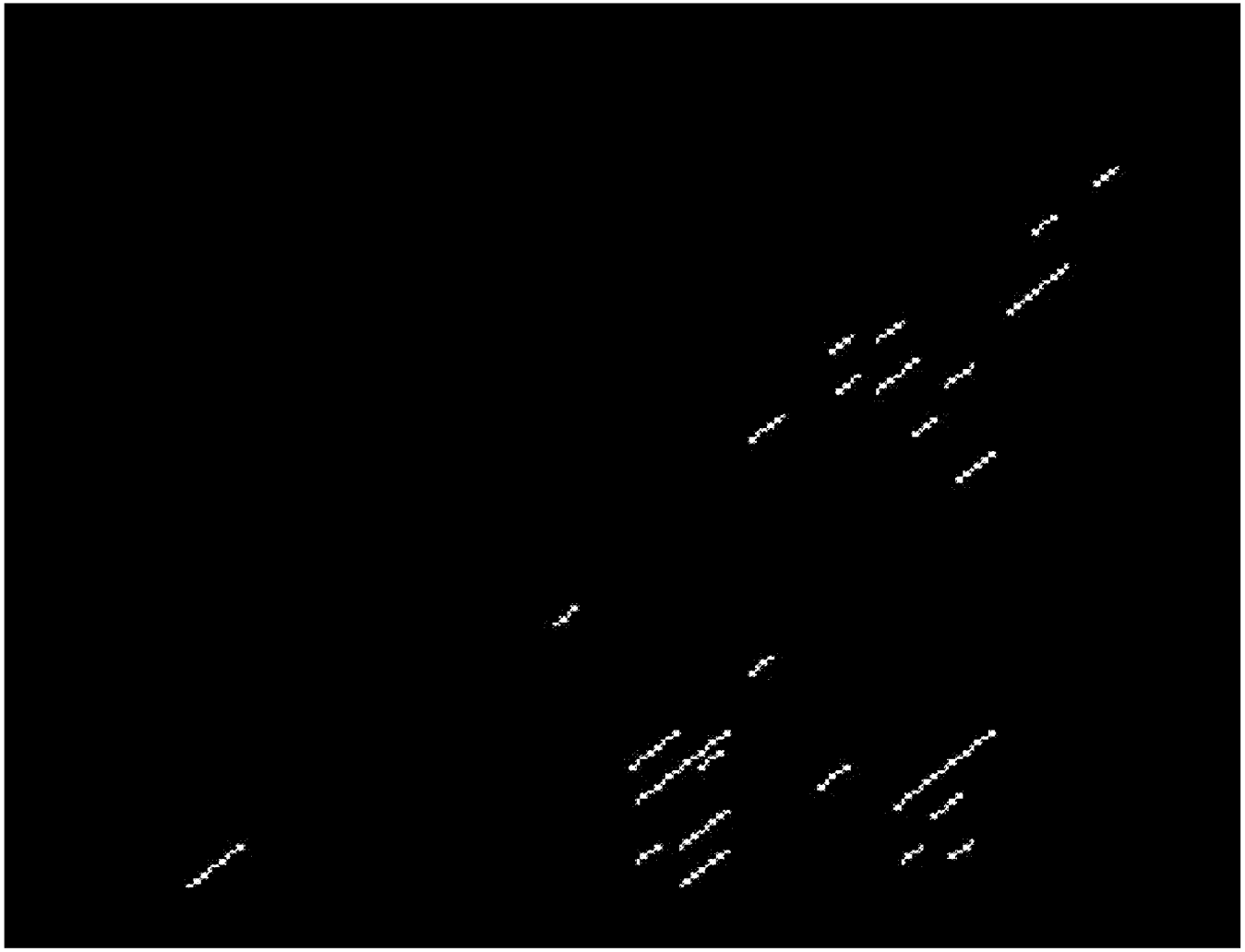

FIG. 3A illustrates the MFCCs matrix of this song. The composition starts on the white cross 31, continues through the two dark diagonal blocks 32 and 33 surrounded with brighter lines. The diagonals that were found represent the chorus. The extracted diagonals are illustrated in FIG. 3B.

In this example, the timbre information shows high correlation to the C-Part, since the C-part has a saxophone entering, the last chorus has the same saxophone. The intro (represented by the white block) is a stretched chord cluster unrelated to the song and even not so self similar.

EXAMPLE 3

Summertime by John Coltrain

Figure 4:
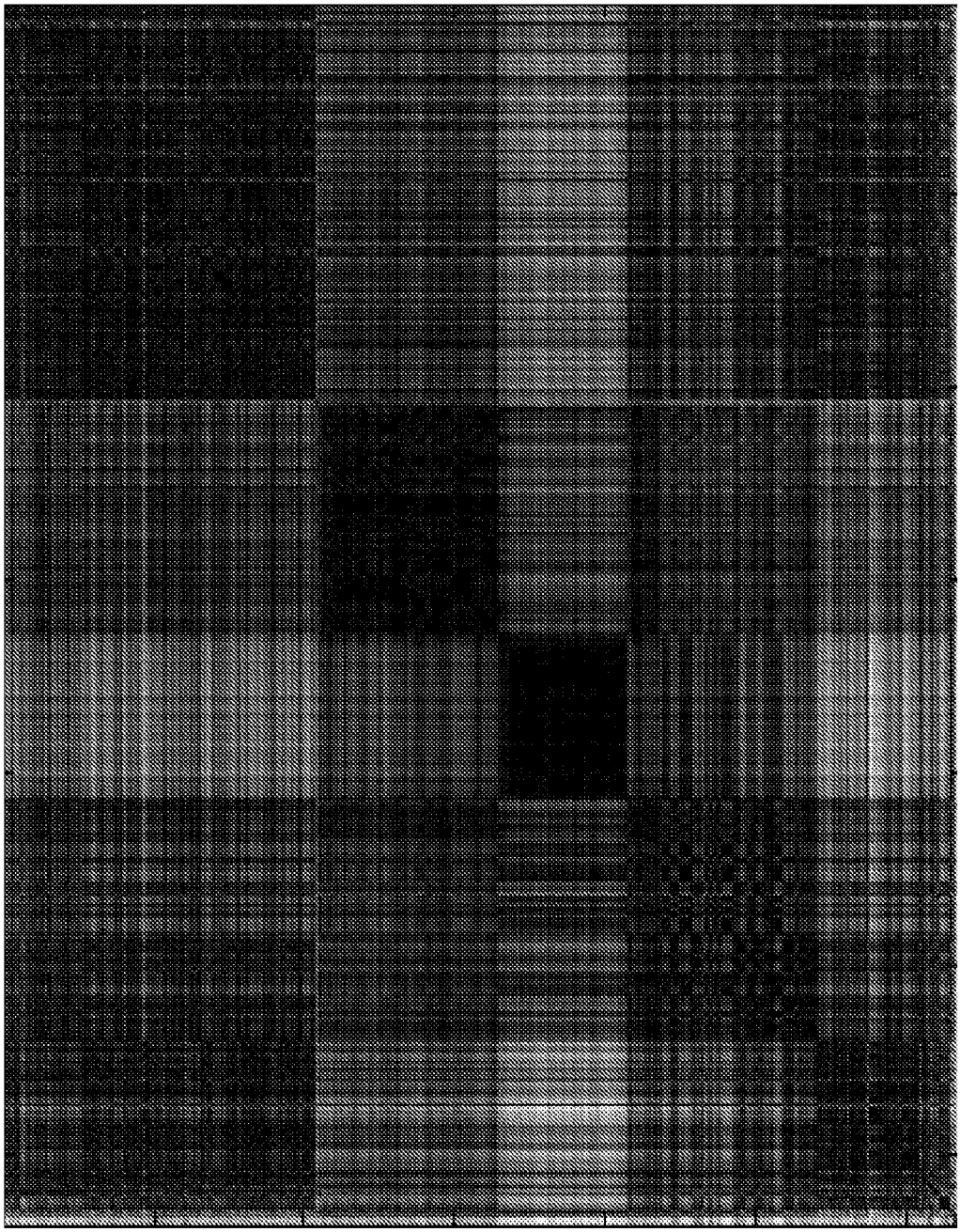
FIG. 4 illustrates the MFCCs matrix of a Jazz composition.

FIG. 4 illustrates the MFCCs matrix of this composition. The different dark blocks along the main diagonal correspond to the different solo segments (Saxophone, Piano, Double-Bass, Drum, and Saxophone). The Double-Bass solo (represented by the bright margins) is different, since the instruments balance changes in this part.

The processing results obtained by the method proposed by the present invention can be also used to for mapping an entire song and providing a graphical interface that allows a DJ (Disc Jockey—a person who plays recorded music for an audience) to view the patterns of different segments the song, as well as the time points of transitions between them. The DJ can see the map and identify the different segments of the song. The DJ can then rapidly browse between them and play the part relevant to the mix.

The method described above allows finding a segment with clear start and end point music-wise, so that the chosen segment stands as a complete and independent unit. This is achieved by finding Bar-Multiplicity for local section, detecting transition points, and Downbeat detection in a bar.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A method for extracting the most representative segments of a musical composition, represented by an audio signal, comprising:

a) preprocessing said audio signal by a set of preprocessors, each of which is adapted to identify a rhythmic pattern within the musical composition;

b) selecting an output of the preprocessors that provides the most periodic or rhythmical patterns within said musical composition;

c) dividing said musical composition into bars having rhythmic patterns, while iteratively checking and scoring their quality and detecting a section being a sequence of bars with a score above a predetermined threshold;

d) iteratively repeating the preceding step until all sections are detected;

e) constructing similarity matrices between all bars that belong to said musical composition, based on MFCCs of the processed sound, chromograms and said rhythmic patterns;

f) extracting equivalent classes of similar sections along said musical composition;

g) collecting substantial transitions between sections represented as blocks in said similarity matrices; and h) selecting a representative segment from each class having the highest number of sections.

2. A method according to claim 1, wherein the metrics used to measure musical similarity are:

a) Mel-Frequency-Cepstrum-Coefficients (MFCCs);

b) Internal Auto-Correlation measure; and c) Tonal-Tuned metric.

3. A method according to claim 1, further comprising:

a) dividing the tracks into equivalent classes by marking diagonals in the similarity matrices, while seeking only sub-diagonals that are inclined in 45°;

b) dividing the similarity matrices into blocks, using local textures and division lines;

c) finding distinctive non-typical sections in each matrix;

d) selecting two representatives to represent the two largest equivalent classes, and a third section containing a distinctive section; and e) adjusting the exact boundaries of the selected parts via the calculated bars multiplicity.

4. A method according to claim 1, wherein detection of bar multiplicities via auto-correlation and deviation above the predicted level.

5. A method according to claim 1, further comprising:

a) dividing the audio signal into portions, based on energy levels; and b) adjusting the accurate boundaries of each section using the time points of transitions between energy levels and rhythmic patterns.

6. A method according to claim 1, further comprising adjusting exact transition points in a graph, using a set-size convolution.

7. A method according to claim 1, wherein the preprocessors are:

low-pass filters;

rhythmical waveform preprocessors;

tuning based signal separation.

8. A method according to claim 1, further comprising defining a representative bar for each section of the musical composition for approximating the local rhythmic pattern finding local periodicity in the processed sound waveform and taking the numeric average over N-periods of T, using autocorrelation.

9. A method according to claim 1, further comprising:

a) defining a correlation scale, which compares a given pair of bars;

b) refining the representative parameters by removing outliers, using said correlation scale;

c) continuously comparing the average bar along the analyzed signal, until the correlation level is degraded;

d) marking the detected part as a rhythmical local constant, which represents a typical rhythmical pattern; and e) iteratively repeating the preceding steps, until the entire signal that corresponds to the most representative segment is extracted.

10. A method according to claim 1, wherein scoring is performed using a rhythmical-score-function based on a ratio between auto-correlation max-peak values and a local mean value around this peak.

11. A method according to claim 1, further comprising separating between stable and unstable frequency components across time frames and between tuned and un-tuned frequencies, using spectral frequency-estimation.

12. A method according to claim 1, further comprising generating a "Thumbnail" that contains examples of both the most representative and most surprising parts of the musical composition.

13. A method according to claim 1, wherein equivalent classes repeat themselves in different time points along the audio file and include: a chorus a verse a hook.

14. A method according to claim 1, wherein a representative bar is defined for a given local section by:

a) constructing an average-bar is by finding local periodicity within a section;

b) taking the numeric average over N-periods of T wherein the average bar approximates the local rhythmic pattern;

refining representative parameters of the bar by removing outlier bars with low correlation are, using the correlation scale; and c) averaging again while excluding the outlier bars.

15. A method according to claim 1, further comprising continuously comparing refined representative bar to an instantaneous bar of essentially similar period along the analyzed signal, while in each time, the next instantaneous bar is selected by hopping in time about the period of a bar, until the correlation level is degraded.

16. A method according to claim 15, wherein the hopping time interval is dynamic.

17. A method according to claim 1, wherein harmonic patches and non-harmonic sounds are filtered by separating frequencies that are located at equal-tempered spots, as well as frequencies that fall within the quartic tone offset.

18. A method according to claim 1, wherein bar multiplicities are detected using auto-correlation and deviation above the predicted level.

19. A method for extracting the most representative segments of a musical composition, represented by an audio signal, comprising:

a) selecting a short section from the beginning of the musical composition;

b) applying the a set of preprocessors on the selected section;

c) using the a scale function to choose the best rhythmical waveform by scoring;

d) performing autocorrelation on the best rhythmical waveform and the maximum over a predetermined range, where the distance between the inducted maximum and the zero offset defines the static bar length of the section;

e) applying a linear estimator on the static bar length periods point in the autocorrelation signal and taking multiplied points which are above the line;

f) using the static bar length to build a representative bar of the section which is defined as the average sum over the n-th static bars contained in the section;

g) refining the representative bar by comparing it with each of the n-th' static bars and taking the average over the five best score bars as the new refined representative bar;

h) inductively identifying a local maximum;

i) saving the 'bad' scored bars in the section; and j) repeating the process, starting from the end of the last section, until segmentation into rhythmical patterns sections is completed.

20. A method comprising:

processing an audio signal by one or more processors each of which is adapted to identify a rhythmic pattern within a musical composition;

selecting an output that provides a periodic or rhythmical pattern within said musical composition;

dividing the musical composition into one or more bars having rhythmic patterns;

constructing one or more similarity matrices between the one or more bars;

extracting equivalent classes along the musical composition;

collecting transitions between sections represented in the one or more similarity matrices; and selecting a representative segment a class having a highest number of sections.

* * * * *